US008137207B2

(12) United States Patent
Brantingham

(10) Patent No.: US 8,137,207 B2
(45) Date of Patent: Mar. 20, 2012

(54) GOLF SWING PRACTICE APPARATUS

(76) Inventor: David E. Brantingham, Taipei (TW)

( * ) Notice: Subject to any disclaimer, the term of this patent is extended or adjusted under 35 U.S.C. 154(b) by 49 days.

(21) Appl. No.: 12/815,664

(22) Filed: Jun. 15, 2010

(65) Prior Publication Data

US 2011/0306433 A1 Dec. 15, 2011

(51) Int. Cl.
*A63B 69/36* (2006.01)

(52) U.S. Cl. ..... 473/140; 473/139

(58) Field of Classification Search ..... 473/138–145, 473/147, 150, 157, 160, 161, 162, 167, 168, 473/278, 279
See application file for complete search history.

(56) References Cited

U.S. PATENT DOCUMENTS

| | | | | | |
|---|---|---|---|---|---|
| 2,656,720 | A | | 10/1953 | Sonnett | |
| 3,658,343 | A | * | 4/1972 | Rogers et al. | 473/161 |
| 3,690,673 | A | * | 9/1972 | Occhipinti | 473/160 |
| 4,327,918 | A | | 5/1982 | Foster | |
| 4,343,469 | A | | 8/1982 | Kunita et al. | |
| 4,437,672 | A | | 3/1984 | Armantrout et al. | |
| 4,451,043 | A | | 5/1984 | Ogawa et al. | |
| 4,958,836 | A | | 9/1990 | Onozuka et al. | |
| 5,056,791 | A | | 10/1991 | Poillon et al. | |
| 5,121,923 | A | * | 6/1992 | D'Allura | 473/140 |
| 5,165,691 | A | | 11/1992 | Cook | |
| 5,172,914 | A | * | 12/1992 | Primerano | 473/171 |
| 5,217,228 | A | | 6/1993 | De Aguilar | |
| D353,179 | S | | 12/1994 | Pittmann | |
| 5,413,345 | A | | 5/1995 | Nauck | |
| 5,435,562 | A | | 7/1995 | Stock et al. | |
| 5,437,457 | A | | 8/1995 | Curchod et al. | |
| 5,460,380 | A | | 10/1995 | Ober | |
| 6,056,645 | A | * | 5/2000 | Servatius | 473/161 |
| 6,059,668 | A | | 5/2000 | Marley, Jr. | |
| 6,257,989 | B1 | * | 7/2001 | Tortola et al. | 473/140 |
| 6,338,682 | B1 | * | 1/2002 | Torchia et al. | 473/160 |
| 6,458,038 | B1 | | 10/2002 | Lin | |
| 6,569,026 | B1 | * | 5/2003 | Weis | 473/139 |
| D500,544 | S | | 1/2005 | Wu | |
| 6,872,150 | B2 | | 3/2005 | Welch | |
| 7,214,136 | B1 | * | 5/2007 | Perry et al. | 473/139 |
| 2005/0107179 | A1 | | 5/2005 | Munshi | |
| 2007/0191128 | A1 | * | 8/2007 | Tirol | 473/150 |
| 2007/0224583 | A1 | | 9/2007 | Humphrey | |
| 2009/0215548 | A1 | | 8/2009 | Broering | |

* cited by examiner

*Primary Examiner* — Nini Legesse
(74) *Attorney, Agent, or Firm* — Biotech Beach Law Group PC

(57) ABSTRACT

A golf swing practice apparatus is provided including a rotating drum, a plurality of laser generating means mounted on the rotating drum, an elongated cord including a proximal end secured to the rotating drum and a distal end secured to a golf ball whereby the golf ball is tethered to the rotating drum, a base member having an impact area over which a user may swing a golf club, and a frame structure secured to the base member and to the rotating drum whereby the frame structure holds the rotating drum in an elevated position above the base member. The rotating drum rotates with the golf ball when the golf ball is struck by the user. At least one of the plurality of laser generating means generates a laser beam which propagates substantially along the path of the golf ball. Additionally, at least one of the plurality of laser generating means generates a laser beam which propagates parallel to a theoretical path of a fairway.

19 Claims, 6 Drawing Sheets

GOLF SWING PRACTICE APPARATUS

FIELD OF THE INVENTION

The present invention relates generally to golf swing practice apparatuses, and more specifically to a golf swing practice apparatus including a plurality of laser generating means mounted on a rotating drum.

BACKGROUND OF THE INVENTION

The game of golf is played on a golf course which usually has eighteen holes. Each hole is a selected distance from a tee-box. A golfer initially hits the ball toward a green that provides a hole into which the ball is to be ultimately directed. In order to reach the green, the golfer employs clubs, either woods or irons, which have different lifts and weight so that the ball flies a calculated distance. Once on the green, the golfer uses a putter to roll the ball until it is ultimately hit into the hole.

It is known that a golfer's game can be improved by practicing hitting the golf ball. While it is relatively easy to practice putting, it is more difficult hitting longer golf shots such as would occur from the tee-box or fairway to the green. This practice hitting or driving is most frequently done at driving ranges. However, using a driving range can be time-consuming, expensive and inconvenient. Additionally, since driving ranges are located outdoors, bad weather may prevent their use.

In light of these difficulties, several golf swing practice devices have been developed to be utilized in a confined area. Such devices include tethered golf ball trainers, laser alignment club trainers, catch nets, and sensor-driven computer simulation systems.

Tethered golf ball trainers are provided by U.S. Pat. No. 2,656,720, U.S. Pat. No. 4,958,836, U.S. Pat. No. 5,460,380, US 2005/0107179, D353,179 and D500,544. Tethered trainers provide the opportunity to use a normal golf club to practice swinging at a golf ball. However, their tether and frame structures often cannot withstand the forces associated with club impact at club head speeds above 70 miles per hour. Additionally, missed swings striking the tether cord may result in lassoing of the tether cord around the golf club head, which can damage the golf club. The club head speed of an average golfer's swing is approximately 80 to 95 miles per hour. However, the speed of an average touring professional golfer's swing is approximately 110 to 125 miles per hour.

Laser alignment club trainers are provided by U.S. Pat. No. 5,165,691, U.S. Pat. No. 5,217,228, U.S. Pat. No. 5,435,562, U.S. Pat. No. 6,059,668, U.S. Pat. No. 6,458,038, U.S. Pat. No. 6,872,150 and US 2009/0215548. Laser alignment club trainers allow a user to visualize the theoretical path of a golf ball based on the orientation of golf club head. However, such trainers require special golf clubs with lasers mounted on or in the shaft or club head.

Sensor-driven computer simulation systems and catch nets are provided by U.S. Pat. No. 4,327,918, U.S. Pat. No. 4,343,469, U.S. Pat. No. 4,437,672, U.S. Pat. No. 4,451,043, U.S. Pat. No. 5,056,791, U.S. Pat. No. 5,437,457 and US 2007/0224583. Sensor-driven computer simulation systems simulate real play by employing a series of optical sensors which gather information about a swing, computing the theoretical path of the golf ball using such information, and displaying the path to a user. However, simulation systems and catch nets are expensive, difficult to install, and require a large space. Additionally, systems employing catch nets require a user to fetch the ball and reset it after each swing.

As such, it may be appreciated that there continues to be a need for a new and improved home-use golf swing practice apparatus which can safely accommodate swings at club head speeds in excess of 70 miles per hour without employing large catch nets or expensive sensor driven computer simulation systems.

SUMMARY OF THE INVENTION

The present invention addresses the deficiencies inherent in current golf practice devices by providing a golf swing practice apparatus which includes a plurality of laser generating means mounted on a rotating drum. More specifically, a first aspect of the present invention provides a golf swing practice apparatus which includes a rotating drum, a plurality of laser generating means mounted on the rotating drum, an elongated cord including a proximal end secured to the rotating drum and a distal end secured to a golf ball whereby the golf ball is tethered to the rotating drum, a base member having an impact area over which a user may swing a golf club, and a frame structure secured to the base member and to the rotating drum whereby the frame structure holds the rotating drum in an elevated position above the base member. The rotating drum rotates with the golf ball when the golf ball is struck by the user. At least one of the plurality of laser generating means generates a laser beam which propagates substantially along the path of the golf ball. At least one of the plurality of laser generating means generates a laser beam which propagates parallel to a theoretical path of a fairway.

The first aspect of the present invention provides several embodiments. In one embodiment, the plurality of laser generating means are laser generating diodes. In another embodiment, the rotating drum includes a center swivel ring and a drum core. The center swivel ring encircles the drum core and can move from side to side over the drum core along the axis of the rotating drum. In another embodiment, the laser generating means which generates a laser beam which propagates substantially along the path of the golf ball is affixed to the center swivel ring and the laser generating means which generates a laser beam which propagates parallel to a theoretical path of a fairway is affixed to the drum core. In another embodiment, the proximal end of the elongated cord is secured to the rotating drum by means of the center swivel ring. In another embodiment, the laser beam which propagates substantially along the path of the golf ball and the laser beam which propagates parallel to a theoretical path of a fairway have different frequencies. In another embodiment, the laser beam which propagates substantially along the path of the golf ball is a green laser beam and the laser beam which propagates parallel to a theoretical path of a fairway is a red laser beam. In another embodiment, the elongated cord is doubled on itself to define a distal cord loop and the distal cord loop passes through the golf ball to secure the golf ball to the elongated cord. In another embodiment, the invention includes a resilient structure which surrounds a distal portion of the elongated cord to prevent the elongated cord from lassoing. In another embodiment, the elongated cord is a nylon rope. In another embodiment, the invention includes a raising means capable of raising the impact area wherein the raising means raises the impact area after the golf ball is struck by the user to interrupt the rotation of the golf ball. In another embodiment, the invention includes a water tank secured to the base member to provide stability to the frame structure when the water tank is filled with water. In another embodiment, the invention includes a means for measuring forces on the rotating drum caused by the motion of the golf ball after the golf ball is struck by the user, a means for computing a theoretical spatial location relative to a fairway to which the golf ball would travel if the golf ball were not tethered to the rotating drum, and a display means having a means of displaying the theoretical spatial location to the user. In another embodiment, the invention includes a means for measuring the speed of rotation of the rotating drum, a means for computing a theoretical distance the golf ball would travel if the golf ball were not tethered to the rotating drum, and a display means having a means of displaying the theoretical distance to the user. In another embodiment, the means of measuring the speed of rotation of the rotating drum includes a magnet secured to the rotating drum and a magnet sensor secured to the frame structure. In another embodiment, the invention includes a means for measuring the speed of rotation of the rotating drum, a means for computing the speed of a golf club head as the golf club head strikes the golf ball, and a display means having a means of displaying the speed to the user. In another embodiment, the means of measuring the speed of rotation of the rotation drum includes a magnet secured to the rotating drum and a magnet sensor secured to the frame structure.

A second aspect of the present invention provides a drum for use with a golf swing practice apparatus which includes a drum core, a center swivel ring, at least one laser generating means mounted on the drum core, at least one laser generating means mounted on the center swivel ring, a tether means for tethering a golf ball to the center swivel ring, and electronic circuitry to electrically communicate the laser generating means to a computer processing unit. In one embodiment, the drum includes an attachment means at a center of the drum core for rotational engagement with a frame structure.

A third aspect of the present invention provides a base member for use with a golf swing practice apparatus which includes a base member comprising an impact surface, a raising means for selectively raising the impact surface, anchoring means for anchoring or securing the base member at a desired spatial location, and electronic circuitry for electrically connecting the raising means to an actuator to initiate raising of the impact surface.

BRIEF DESCRIPTION OF THE DRAWINGS

Those of skill in the art will understand that the drawings, described below, are for illustrative purposes only. The drawings are not intended to limit the scope of the present teachings in any way.

DETAILED DESCRIPTION OF THE INVENTION

Figure 1:
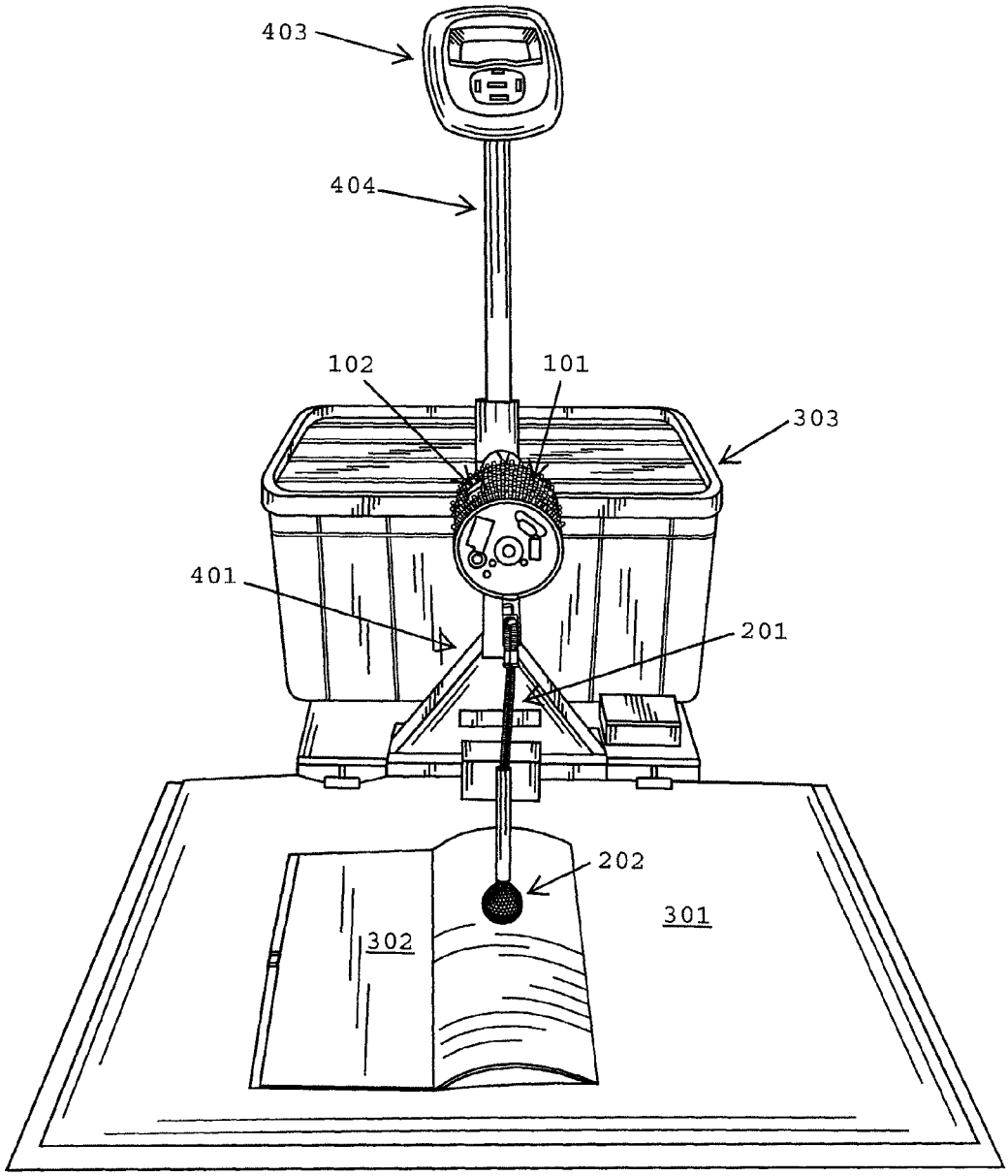
FIG. 1 is a front perspective view of one embodiment of the first aspect of the present invention.

Referring generally to FIGS. 1-7, the first aspect of the present invention provides a rotating drum 101, an elongated cord 201, a golf ball 202, a base member 301, and a frame structure. Rotating drum 101 includes a plurality of laser generating means mounted thereon. Elongated cord 201 includes a proximal end secured to rotating drum 101 and a distal end secured to golf ball 202 whereby golf ball 202 is tethered to rotating drum 101. Base member 301 includes an impact area over which a user may swing a golf club. The frame structure includes frame structure base 401 and frame structure arm 402. Frame structure base 401 is secured to base member 301 and frame structure arm 402 is secured to rotating drum 101 whereby the frame structure holds rotating drum 101 in an elevated position above base member 301. Rotating drum 101 is secured to frame structure arm 402 whereby rotating drum 101 can rotate freely about frame structure arm 402. Rotating drum 101 and golf ball 202 rotate around frame structure arm 402 when golf ball 202 is struck by a user to impart flight thereto. As rotating drum 101 and golf ball 202 rotate around frame structure arm 402, at least one laser generating means 102 generates a laser beam which propagates substantially along the path of golf ball 202 and at least one laser generating means 103 generates a laser beam which propagates parallel to a theoretical path of a fairway.

In some embodiments, elongated cord 201 is doubled on itself to define a distal cord loop and the distal cord loop passes through two holes in golf ball 202 to secure golf ball 202 to elongated cord 201. Preferably, the two holes are located on golf ball 202 at an angle relative to each other between 45° and 90°. Preferably, elongated cord 201 is a 4 mm nylon rope doubled on itself and golf ball 202 is a standard two-piece golf ball. Preferably, a distal portion of elongated cord 201 is surrounded by a resilient structure 203. Preferably, resilient structure 203 is 130-150 mm in length and is constructed of rubber. Preferably, two golf balls with elongated cords of different lengths are provided; one 355-365 mm long for use with woods and one 385-395 mm long for use with irons.

In some embodiments, the proximal end of elongated cord 201 is threaded in a FIG. 8 pattern through a female insert 204. The proximal end strands of the cord are then crimped together with a steel clip 205. Female insert 204 threads into a male insert 104, as discussed below. Preferably, female insert 204 and male insert 104 are constructed of steel.

In some embodiments, the plurality of laser generating means are laser generating diodes. Preferably, the plurality of laser generating means include three laser generating means—one laser generating means 102 and two laser generating means 103. Preferably, laser generating means 102 and 103 illuminate only when rotating drum 101 is rotating, which saves battery life and prevents the laser beams from distracting the user at address. As rotating drum 101 rotates around frame structure arm 402, laser generating means 102 projects a green laser beam which follows the plane of rotating golf ball 202. Concurrently, laser generating means 103 project two red lines which simulate the path of a fairway. The resulting visual cue, which appears as three continuous laser beams on the floor, ceiling and adjacent walls, provides instant visual feedback to the user as to how square or straight golf ball 202 was hit at impact. If the green laser line stays within the two red laser lines, then the user knows the ball was hit straight.

Figure 3:
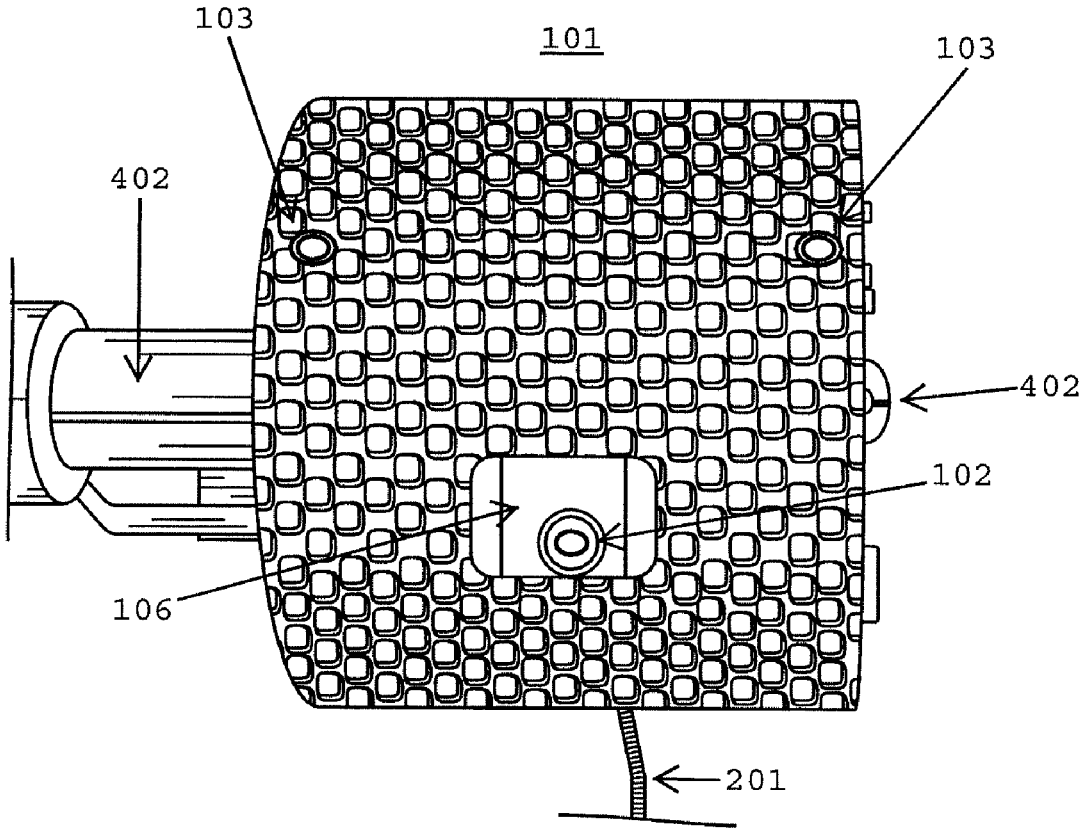
FIG. 3 is an enlarged top perspective view of one embodiment of rotating drum 101.
Figure 4:
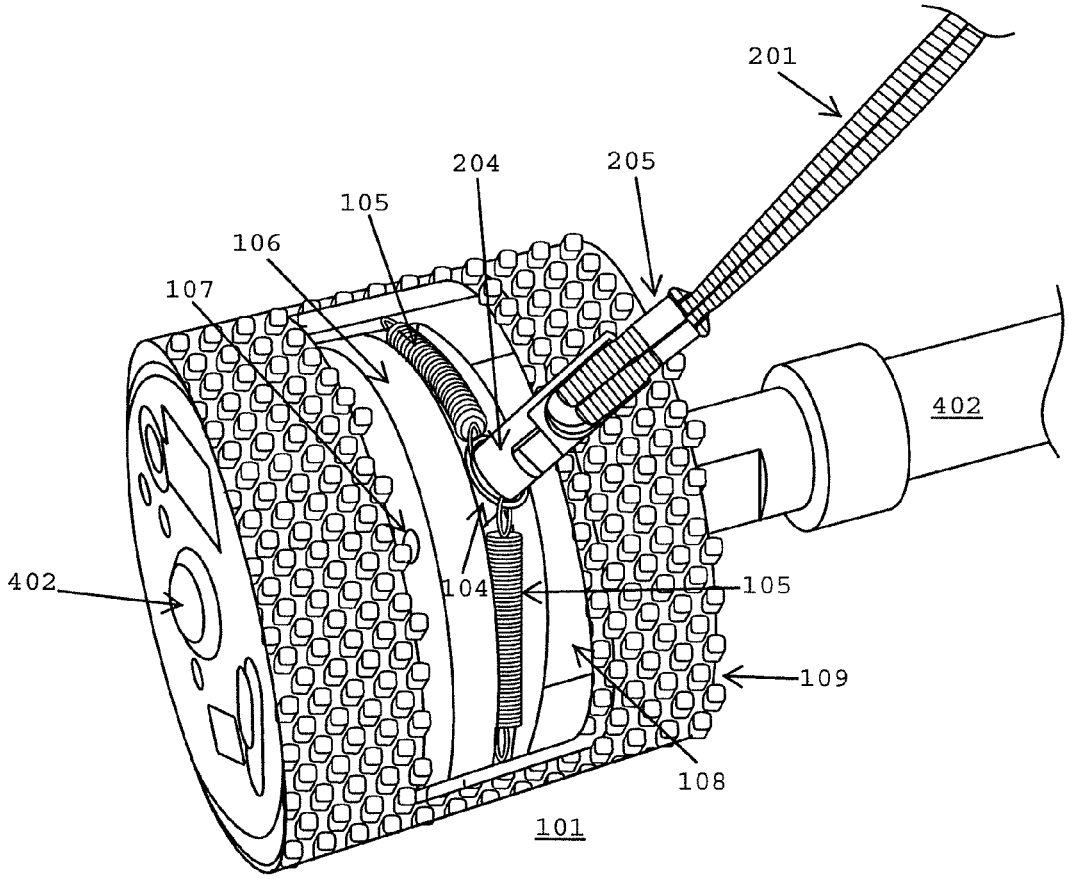
FIG. 4 is a bottom perspective view thereof.

In some embodiments, rotating drum 101 includes a drum core 108 which rotationally engages frame structure arm 402, a center swivel ring 106 which encircles drum core 108, and a drum cover 109 which is affixed to drum core 108 and covers drum core 108 and center ring 106. Referring to FIGS. 3 and 4, center swivel ring 106 can move from side to side over drum core 108 along the axis of rotating drum 101. Laser generating means 103 are mounted on drum core 108 perpendicular to the axis of rotating drum 101 such that laser generating means 103 project two red lines perpendicular to the axis of rotating drum 101 to outline a fairway. Laser generating means 102 is mounted on center swivel ring 106 and the proximal end of elongated cord 201 is secured to center swivel ring 106 such that the forces applied by rotating golf ball 202 cause center swivel ring 106 to move from side to side over drum core 101 and the green line projected by laser generating means 102 to follow the plane of rotation of golf ball 202. Drum cover 109 includes apertures exposing laser generating means 102 and 103 and male insert 104. Male insert 104 is secured to center swivel ring 106 by means of a pin 107 and is located in a crevice along a portion of the circumference of center swivel ring 106. Elongated cord 201 is secured to rotating drum 101 by means of female insert 204 which threads into male insert 104. Male insert 104 can swing freely in the crevice in directions perpendicular to the axis of rotating drum 101 to absorb ball impact forces. Springs 105 may be secured to either side of male insert 104 and to the ends of the crevice to further absorb impact forces.

In some embodiments, the frame structure is constructed of steel. Preferably, frame structure arm 402 is height-adjustable and is constructed of solid steel which can safely withstand impact and centrifugal forces induced by a 145 miles per hour swing.

In some embodiments, the frame structure includes an upper frame structure 404 affixed at a proximal end to frame structure base 401 and at a distal end to a display means 403. Display means 403 may display any or all of the following: club selection, ball flight distance, club head speed, ball angle, driving accuracy percentage, total swings, best shots, and averages.

In the some embodiments, base member 301 is a two-layered mat. The top layer is a turf mat and the bottom layer is a 3-7 mm rubber mat which adds rigidity and cushions a swing impact. Both layers may be soft and foldable. Alternatively, the bottom layer may be a constructed of rigid plastic.

Figure 2:
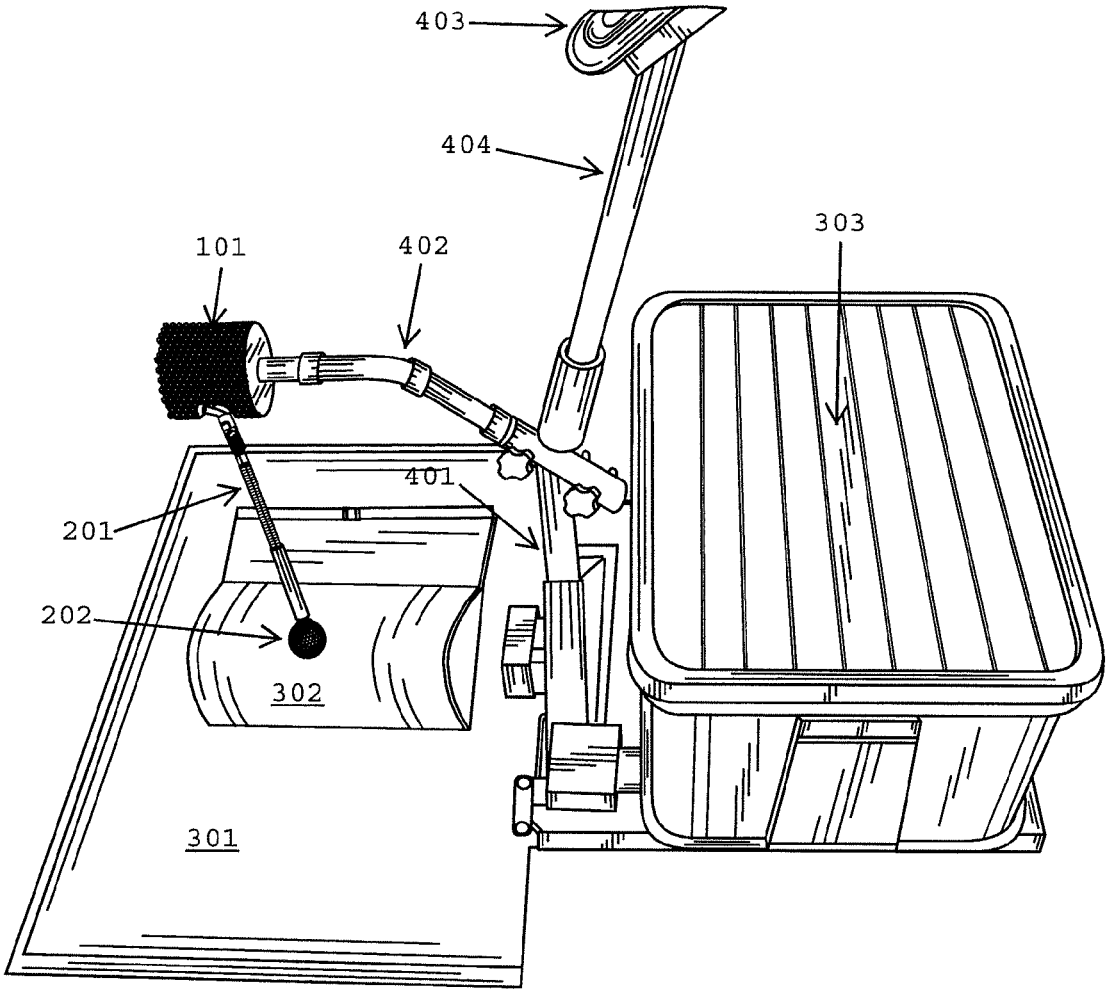
FIG. 2 is a side perspective view thereof.
Figure 5:
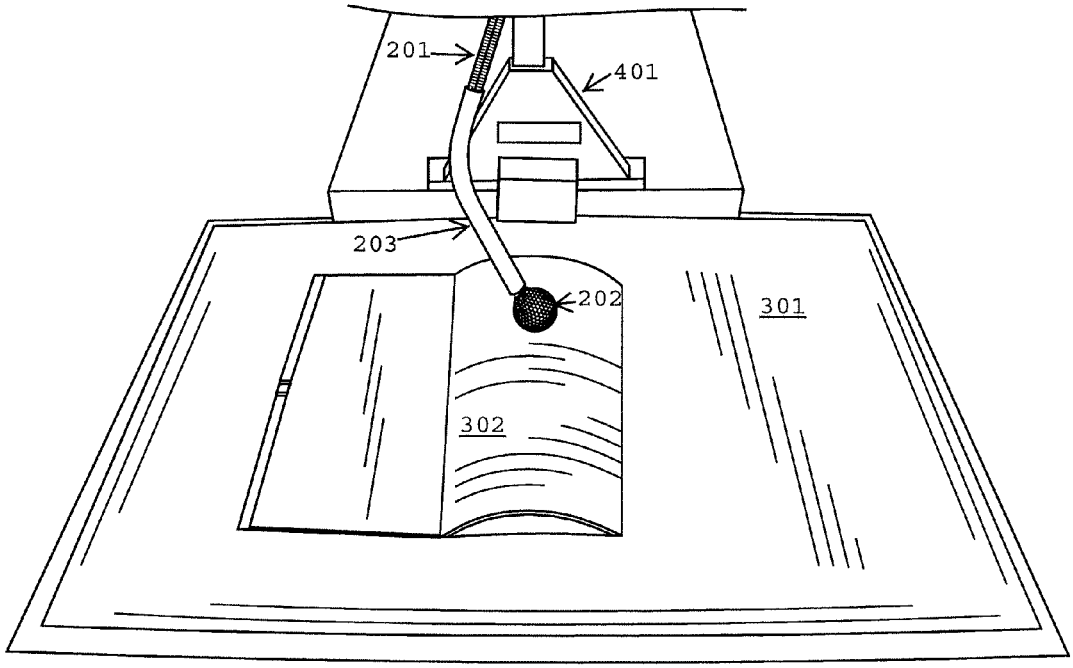
FIG. 5 is an enlarged front perspective view of one embodiment of base member 301.
Figures 6, 7:
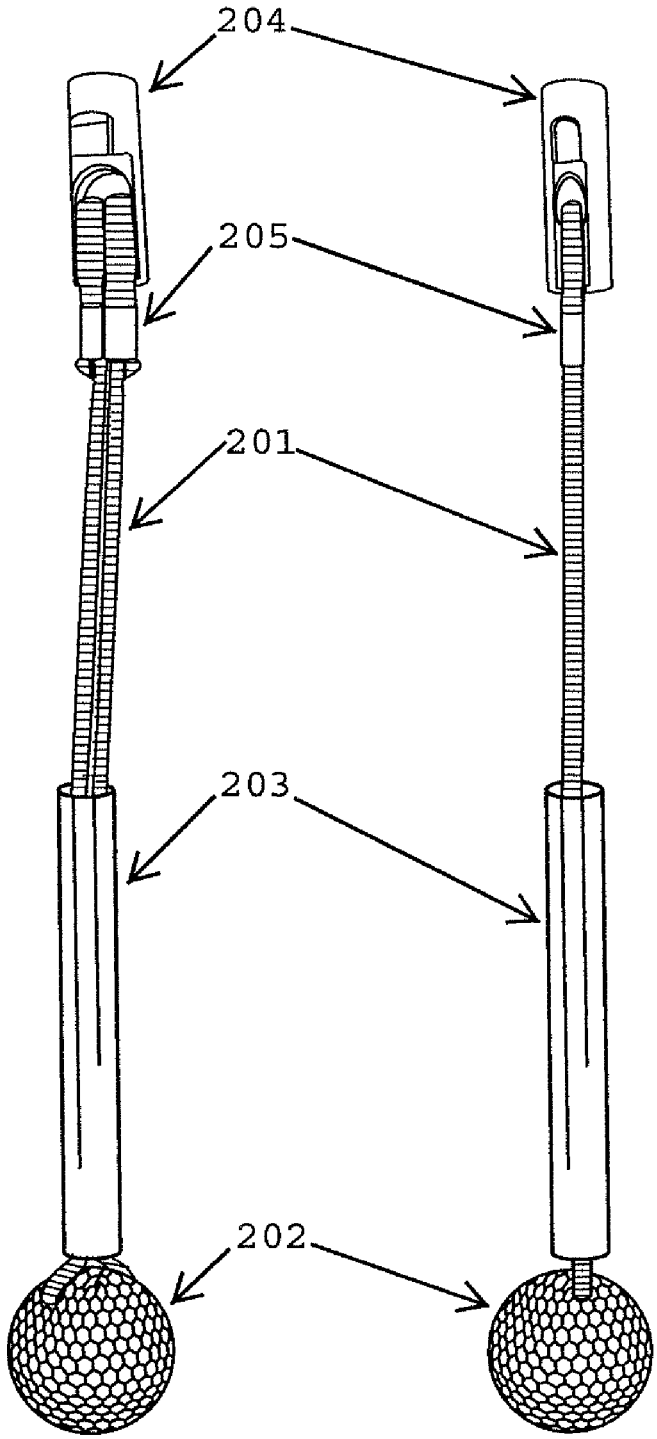
FIG. 6 is an enlarged front elevational view of one embodiment of elongated cord 201 and golf ball 202.
FIG. 7 is a side elevational view thereof.

In some embodiments, base member 301 includes a raising means capable of raising impact area 302 wherein the raising means raises impact area 302 after golf ball 202 is struck by the user to interrupt the rotation of golf ball 202. Preferably, the raising means raises impact area 302 after golf ball 202 has made several revolutions. Raised impact area 302 stops golf ball 202 and sets it for the next swing. Accordingly, the user need not move from his stance between swings. FIGS. 1, 2, and 5 show impact area 302 in a raised position. FIG. 5 shows raised impact area 302 interrupting the rotation of golf ball 202 after golf ball 202 has made several revolutions.

In the some embodiments, raisable impact area 302 is a three-sided flap cut out from a center portion of the top layer of base member 301. Referring to FIGS. 1, 2, and 5, the raising means includes an elastic band which is attached to the underside left end of the flap. The elastic band stretches to the opposite end of base member 301 (the right end), where it is anchored to the rubber mat. The tension of the elastic band causes the flap to bow upwards in the center. A motor assembly is attached to base member 301. A cable is attached to the motor assembly and runs from the motor assembly underneath the rubber mat to a mechanical slide mechanism that is mounted on the bottom rubber mat, directly under the flap. The left side of the flap is attached to the slide mechanism. When the motor is not activated (off position) the motor cable is wound tight and pulls the flap to the left, thus flattening the bow and lowering the flap to a flat position, flush with the rest of the top layer of base member 301. When the motor is activated, cable is fed out (tension released) and the flap is pulled to the right by the elastic band which causes the flap to bow upwards.

In some embodiments, the invention includes a water tank 303 secured to base member 301 to provide stability to the frame structure when water tank 303 is filled with water. Preferably, water tank 303 is a specially designed 17 gallon water container which securely anchors base member 301 to the ground or floor when filled to accommodate the centrifugal forces on the ball-tether system. The combined weight of base member 301 and 17 gallons of water provides over 170 lbs of weight to offset the impact and centrifugal forces of a 145 mile per hour swing. The container is easy to fill and empty, facilitating the transport of the present invention from place to place, such as from the basement or garage out to the patio or lawn.

Having described the invention in detail, it will be apparent that modifications, variations, and equivalent embodiments are possible without departing the scope of the invention defined in the appended claims.

What is claimed is:

1. A golf swing practice apparatus, comprising:

(a) a rotating drum;

(b) a plurality of laser generating means mounted on the rotating drum;

(c) an elongated cord comprising a proximal end secured to the rotating drum and a distal end secured to a golf ball whereby the golf ball is tethered to the rotating drum;

(d) a base member having an impact area over which a user may swing a golf club; and (e) a frame structure secured to the base member and to the rotating drum whereby the frame structure holds the rotating drum in an elevated position above the base member;

wherein the rotating drum rotates with the golf ball when the golf ball is struck by the user;

wherein at least one of the plurality of laser generating means generates a laser beam which propagates substantially along the path of the golf ball;

wherein at least one of the plurality of laser generating means generates a laser beam which propagates parallel to a theoretical path of a fairway.

2. The golf swing practice apparatus of claim 1, further wherein the plurality of laser generating means are laser generating diodes.

3. The golf swing practice apparatus of claim 1, further wherein the rotating drum comprises a center swivel ring and a drum core, further wherein the center swivel ring encircles the drum core and can move from side to side over the drum core along the axis of the rotating drum.

4. The golf swing practice apparatus of claim 3, further wherein the laser generating means which generates a laser beam which propagates substantially along the path of the golf ball is affixed to the center swivel ring and the laser generating means which generates a laser beam which propagates parallel to a theoretical path of a fairway is affixed to the drum core.

5. The golf swing practice apparatus of claim 3, further wherein the proximal end of the elongated cord is secured to the rotating drum by means of the center swivel ring.

6. The golf swing practice apparatus of claim 1, further wherein the laser beam which propagates substantially along the path of the golf ball and the laser beam which propagates parallel to a theoretical path of a fairway have different frequencies.

7. The golf swing practice apparatus of claim 1, further wherein the laser beam which propagates substantially along the path of the golf ball is a green laser beam and the laser beam which propagates parallel to a theoretical path of a fairway is a red laser beam.

8. The golf swing practice apparatus of claim 1, further wherein the elongated cord is doubled on itself to define a distal cord loop and the distal cord loop passes through the golf ball to secure the golf ball to the elongated cord.

9. The golf swing practice apparatus of claim 1, further comprising a resilient structure which surrounds a distal portion of the elongated cord to prevent the elongated cord from lassoing.

10. The golf swing practice apparatus of claim 1, further wherein the elongated cord is a nylon rope.

11. The golf swing practice apparatus of claim 1, further comprising a raising means capable of raising the impact area wherein the raising means raises the impact area after the golf ball is struck by the user to interrupt the rotation of the golf ball.

12. The golf swing practice apparatus of claim 1, further comprising a water tank secured to the base member to provide stability to the frame structure when the water tank is filled with water.

13. The golf swing practice apparatus of claim 1, further comprising:

(a) a means for measuring forces on the rotating drum caused by the motion of the golf ball after the golf ball is struck by the user;

(b) a means for computing a theoretical spatial location relative to a fairway to which the golf ball would travel if the golf ball were not tethered to the rotating drum; and (c) a display means having a means of displaying the theoretical spatial location to the user.

14. The golf swing practice apparatus of claim 1, further comprising:

(a) a means for measuring the speed of rotation of the rotating drum;

(b) a means for computing a theoretical distance the golf ball would travel if the golf ball were not tethered to the rotating drum; and (c) a display means having a means of displaying the theoretical distance to the user.

15. The golf swing practice apparatus of claim 14, wherein the means of measuring the speed of rotation of the rotating drum comprises:

(a) a magnet secured to the rotating drum; and (b) a magnet sensor secured to the frame structure.

16. The golf swing practice apparatus of claim 1, further comprising:

(a) a means for measuring the speed of rotation of the rotating drum;

(b) a means for computing the speed of a golf club head as the golf club head strikes the golf ball; and (c) a display means having a means of displaying the speed to the user.

17. The golf swing practice apparatus of claim 16, wherein the means of measuring the speed of rotation of the rotation drum comprises:

(a) a magnet secured to the rotating drum; and (b) a magnet sensor secured to the frame structure.

18. A drum for use with a golf swing practice apparatus, comprising:

(a) a drum core;

(b) a center swivel ring;

(c) at least one laser generating means mounted on the drum core;

(d) at least one laser generating means mounted on the center swivel ring;

(d) a tether means for tethering a golf ball to the center swivel ring; and (e) electronic circuitry to electrically communicate the laser generating means to a computer processing unit.

19. The drum of claim 18, further wherein the drum core comprises an attachment means at a center of the drum core for rotational engagement with a frame structure.

* * * * *

UNITED STATES PATENT AND TRADEMARK OFFICE

CERTIFICATE OF CORRECTION

PATENT NO. : 8,137,207 B2
APPLICATION NO. : 12/815664
DATED : March 20, 2012
INVENTOR(S) : David E. Brantingham It is certified that error appears in the above-identified patent and that said Letters Patent is hereby corrected as shown below:

In the claims

Column 8, line 27:

Please delete "(d) a tether means for tethering a golf ball to the center swivel ring; and"

and insert -- (e) a tether means for tethering a golf ball to the center swivel ring; and --

Column 8, line 29:

Please delete "(e) electronic circuitry to electrically communicate the laser generating means to a computer processing unit."

and insert -- (f) electronic circuitry to electrically communicate the laser generating means to a computer processing unit. --

Signed and Sealed this
Twenty-eighth Day of June, 2016

Michelle K. Lee

Michelle K. Lee
*Director of the United States Patent and Trademark Office*